US007186936B2

(12) United States Patent
Marcus et al.

(10) Patent No.: US 7,186,936 B2
(45) **Date of Patent: *Mar. 6, 2007**

(54) ELECTROLUMINESCENT LAMP MEMBRANE SWITCH

(75) Inventors: M. Richard Marcus, Dallas, TX (US); Thomas L. Brown, Mesa, AZ (US)

(73) Assignee: OryonTechnologies, LLC, Addison, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/438,182

(22) Filed: May 22, 2006

(65) Prior Publication Data

US 2006/0278508 A1 Dec. 14, 2006

Related U.S. Application Data

(63) Continuation of application No. 11/148,216, filed on Jun. 9, 2005, now Pat. No. 7,049,536.

(51) Int. Cl.
*H01H 9/16* (2006.01)

(52) U.S. Cl. ..... 200/310; 200/314; 200/317

(58) Field of Classification Search ..... 200/5 A, 200/512, 310–317; 341/22; 313/483–522, 313/463; 345/168–176; 349/69; 365/110, 365/111; 427/66

See application file for complete search history.

(56) References Cited

U.S. PATENT DOCUMENTS 3,875,449 A 4/1975 Byler
4,060,703 A 11/1977 Everett, Jr.
4,104,555 A 8/1978 Fleming
4,320,268 A 3/1982 Brown
4,532,395 A 7/1985 Zukowski
4,548,646 A 10/1985 Mosser et al.
4,647,337 A 3/1987 Simopoulos et al.
4,683,360 A 7/1987 Maser
4,684,353 A 8/1987 deSouza
4,743,895 A 5/1988 Alexander
4,816,717 A 3/1989 Harper
4,853,079 A 8/1989 Simopoulos
4,853,594 A 8/1989 Thomas
4,999,936 A 3/1991 Calamia
5,041,326 A 8/1991 Schroeder
5,184,969 A 2/1993 Sharpless
5,243,060 A 9/1993 Barton
5,317,488 A 5/1994 Penrod
5,336,345 A 8/1994 Gustafson
5,475,574 A 12/1995 Chien
5,491,377 A 2/1996 Janusaukas
5,496,427 A 3/1996 Gustafson
5,559,680 A 9/1996 Tabanera
5,565,733 A 10/1996 Krafcik
5,567,040 A 10/1996 Tabanera (Continued)

OTHER PUBLICATIONS

Ellington, Jr. W. W., "Luminescing Flexible Switch", IBM Technical Disclosure Bulletin, Vol. 13, No. 3, p. 742, Aug. 1970.

*Primary Examiner*—Michael A. Friedhofer
(74) *Attorney, Agent, or Firm*—Locke Liddell & Sapp, LLP

(57) ABSTRACT

An electroluminescent lamp membrane switch includes a deformable substrate. Graphic indicia is imprinted on the substrate. An electroluminescent lamp is imprinted on the graphic indicia layer and a membrane switch is formed on the lamp.

24 Claims, 11 Drawing Sheets

U.S. PATENT DOCUMENTS 5,569,893 A 10/1996 Seymour
5,570,945 A 11/1996 Chien
5,597,183 A 1/1997 Johnson
5,611,621 A 3/1997 Chien
5,680,160 A 10/1997 LaPointe
5,688,038 A 11/1997 Chien
5,701,189 A 12/1997 Koda
5,704,705 A 1/1998 Chien
5,726,953 A 3/1998 LaPointe
5,746,501 A 5/1998 Chien
5,747,756 A 5/1998 Boedecker
5,770,920 A 6/1998 Eckersley
5,772,924 A 6/1998 Hayashi
5,794,366 A 8/1998 Chien
5,797,482 A 8/1998 LaPointe
5,806,960 A 9/1998 Chien
5,810,467 A 9/1998 Hurwitz
5,811,930 A 9/1998 Krafcik
5,818,174 A 10/1998 Ohara
5,836,671 A 11/1998 Chien
5,856,029 A 1/1999 Burrows
5,856,030 A 1/1999 Burrows
5,856,031 A 1/1999 Burrows
5,860,727 A 1/1999 Chien
5,865,523 A 2/1999 Chien
5,871,088 A 2/1999 Tanabe
5,871,271 A 2/1999 Chien
5,879,069 A 3/1999 Chien
5,921,653 A 7/1999 Chien
5,947,580 A 9/1999 Chien
5,980,976 A 11/1999 Burrows
6,100,478 A 8/2000 LaPointe
6,144,157 A 11/2000 Rogers
6,198,217 B1 3/2001 Suzuki
6,261,633 B1 7/2001 Burrows
6,270,834 B1 8/2001 Burrows
6,271,631 B1 8/2001 Burrows
6,309,764 B1 10/2001 Burrows
6,373,008 B1 4/2002 Saito et al.
6,379,743 B1 4/2002 Lee
6,512,250 B1 1/2003 Koyama
6,698,085 B2 3/2004 Stevenson
6,717,361 B2 4/2004 Burrows
6,824,288 B2 11/2004 Prindle
6,875,938 B2 4/2005 Schmiz et al.
7,049,536 B1 * 5/2006 Marcus et al. ..... 200/310
2001/0037933 A1 11/2001 Hunter
2003/0041443 A1 3/2003 Stevenson
2004/0069607 A1 4/2004 Hunger

* cited by examiner

ELECTROLUMINESCENT LAMP MEMBRANE SWITCH

RELATED APPLICATION

This application is a continuation of U.S. patent application Ser. No. 11/148,216 filed Jun. 9, 2005 and entitled "Electroluminescent Lamp Membrane Switch" and now U.S. Pat. No. 7,049,536, issued May 23, 2006.

TECHNICAL FIELD OF THE INVENTION

The present invention relates to membrane switches, and more particularly to an integrated electroluminescent lamp system and membrane switch which reduces labor costs and cycle time in membrane switch manufacturing.

BACKGROUND OF THE INVENTION

Conventional membrane switches are typically manufactured individually by laminating several independent elements with interposed double-sided adhesive sheets. The steps of die cutting, lamination, and assembly are repeated multiple times during manufacturing leading to a labor intensive and slow process. The typical elements of a membrane switch include a graphic layer, laminating adhesive, embossed electrical contactors, spacer, electrical contact, laminate adhesive, and backing. These elements are individually manufactured, individually die cut and assembled layer by layer. Additionally, in many cases additional steps are required when adding an electroluminescent lamp and/or LED to backlight the switches. Additional steps are required to provide tactile feel using metal domes, poly domes, or magnetic switches. Indicator lights, and digital or alphanumerical displays are also often used either as a part of the membrane switch or adjacent to the switch.

Referring to FIG. 1, an exploded view of a conventional membrane switch using electroluminescent lamp technology is illustrated, and is generally identified by the numeral 20. Layer 22 is a substrate with a printed graphic element 24. A typical substrate layer 22 is made of polyester or polycarbonate with thicknesses of 3 to 7 mils. The graphic element 24 is usually on the bottom face so that substrate 22 will protect the graphic element 24. Typically, graphic printing is completed in a batch process. The printing flow is broken up by the operation of die cutting. This cut out piece that typically includes substrate layer 22 and graphic element 24 is called a graphical overlay.

Layer 26 is an electroluminescent lamp printed on an Indium Tin Oxide (ITO) sputtered substrate. The substrate is typically polyester or polycarbonate, 3 to 5 mils thick. The substrate is sputtered with ITO. The ITO sputtered substrate is screen printed with the following layers: Silver ink bus bars 0.5 to 1.0 mils thick, Phosphor 1 to 1.5 mils thick, Dielectric layer containing barium titanate 0.2 to 0.6 mils thick, back electrode of silver or graphite filled inks 0.5 to 1 mils thick, insulating layer 2 to 6 mils thick. Once the lamp layer 26 has been successfully printed, it is die cut from the substrate.

Layer 22 and the lamp layer 26 are joined together in a laminating step. Layer 28 is a double-sided laminating adhesive and is die cut to the same size as the layer 22 and lamp layer 26. The double-sided laminating adhesive layer 28 attaches the lamp layer 26 to the layer 22. Alignment and removal of air bubbles are critical in lamination steps and are serious sources of defects.

A conductive contact element layer 30 is used to actuate the switches. This layer may include metal domes, polymer domes coated with a conductive layer or flat electrical contactors. The electrical contactors are used when a simple electrical contact is needed. The purpose of metal domes and poly domes is to give a tactile response when the switch is depressed. Conductive layer 30 is connected to lamp layer 26 using an adhesive layer 32.

Layer 34, the electrical circuit and contact points for the switch, is composed of a substrate of polyester or polycarbonate 3 to 7 mils thick. A first layer of conductive ink is printed on the substrate. These inks are often made with silver or graphite as the conductive elements. If more than one conductive layer is needed, an insulating layer is printed next to protect the first conductive layer. A second conductive layer is then printed. After successfully completing these steps the circuit layer 34 is then die cut.

A spacer layer 36 is also die cut. The spacer layer 36 is approximately the same thickness as the metal domes and has adhesive on both sides. After die cutting the spacer layer 36, layer 36 and the circuit layer 34 are laminated together. Metal domes 38 are then placed in the holes 40 of the spacer layer 36 either manually or by a pick and place machine. Conductive layer 30 is applied over the spacer layer 36 and laminated into place.

The metal domes 38 and electrical circuit layer 34 are laminated to the conductive layer 30 using a double-sided laminating adhesive layer 36. Adhesive layer 36 is die cut to the proper size before the lamination step.

A final laminating adhesive layer 42 is applied to circuit layer 34. The laminating adhesive layer 42 is die cut into the desired shape and is applied to the back of the electrical circuit layer 34. A release liner layer 44 is left on the laminating adhesive until the finished membrane switch 20 is applied to its final location on a circuit board or electronics enclosure.

In addition to the labor necessary to assemble these many different layers (FIG. 1) there are significant quality and manufacturing issues that arise from the lamination steps required to produce a conventional membrane switch. These include, but are not limited to, die cut registration, alignment of the various layers, and removal of air trapped in the lamination process. Because the membrane switches are die cut each individual membrane switch must be processed one at a time.

Moreover, the placement of discreet lighting elements such as light emitting diodes, the connection of these elements to electrical traces with the use of conductive polymers, and the curing of these polymers are all very labor intensive operations. These operations steps may not be part of the membrane switch manufacturer's process. Hence, the manufacturer may outsource these operations to a third party vendor resulting in a disruption of the normal manufacturing flow.

When electroluminescent lamp lighting is used it is advantageous to place both the graphic and the lamp behind the deformable substrate. The deformable substrate is typically composed of either polyester or polycarbonate material that is very rugged and durable to environmental conditions. Common sources of electroluminescent lamp lighting do not allow graphics to be printed directly between the substrate and the optically transmissive conductive layer of the lamp nor do they permit graphic layers to be printed between the ITO and other layers of the lamp. This is because the graphic layers interfere with the electrical connection to the ITO conductive layer often used on the substrate and/or the graphic layer may contaminate other clear conductive layers that may be used instead of ITO.

Therefore, a need exists for combining electroluminescent lamp technology and membrane switch elements into a continuous manufacturing process that eliminates the conventional batch process used for lamination steps and the labor required to assemble the layers of the switch while protecting the graphics.

SUMMARY OF THE INVENTION

The present invention addresses the above-described problems by printing layers of a membrane switch and an electroluminescent lamp in a single continuous process, layer after layer, without the need to stop and die cut and assemble these layers. In an embodiment, the layers are screen printed primarily with UV-curable inks. When these inks are deployed in layer form and exposed to UV radiation, the inks cure quickly, thus improving process cycle time and leading to a continuous process. The continuous process is defined by the ability to cure each layer in seconds on a conveyor system and to print one layer right after the previous layer without taking the in-process membrane switch components to other steps such as die cutting and assembly. In addition, the switches are processed on sheets each containing multiple switches where all switches on any given sheet receive the same process steps simultaneously. The layer shape is formed during screen printing thus eliminating the need for the process steps of die cutting and assembly. There is no need to stop this process between the graphics layers, the lamp layers, the electrical elements of either, electrical contactors or circuits, insulating layers, spacer layers and contact adhesive layers; these can all be printed in one continuous process. There is a reduction in cycle time due to the elimination of the die cutting and expensive labor intensive lamination steps. There is an optimization of handling time through the use of a continuous system because each layer now prints and cures in seconds. The membrane switches are processed on sheets containing many switches instead of processing each switch individually. In addition, the number of die cutting operations is reduced to just one or two. Manufacturing is significantly optimized over traditional die cutting, lamination and assembly processes for individual lamps.

The reduction in cycle time and the elimination of the die cutting step and assembly steps can transform a batch processing to a continuous process. The process may involve curing on UV conveyor systems between printing stations as is well known in the art. There is a reduction in cycle time by the elimination of the die cutting and expensive labor intensive lamination steps, because each layer now can be printed and cured in seconds; there is an optimization of handling time through the use of a continuous system. Accordingly, a technical advantage of the present invention is that cycle times for the inventive membrane switch manufacturing processes are dramatically reduced.

In accordance with the present invention, a depressable substrate is coated with a graphical layer and in a continuous process further coated with an electroluminescent lamp having a polyurethane insulation layer formed on the graphic layer. This structure provides the benefit of the graphic layer and the electroluminescent lamp being protected behind the substrate. The polyurethane insulating layer also protects the sensitive electroluminescent layers from contamination from the graphical inks.

Graphical layers and electroluminescent lamp lighting may also be advantageously combined to form display elements. These display elements can be used to convey information such as status, numerical or alphanumerical data. The marginal cost of providing these display elements is very low because they can be printed simultaneously with the lamp and graphics without adding additional process steps.

The present invention results in a reduction of the total number of layers and the substrates contained in those layers and in the elimination of multiple assembly steps through a continuous printing and UV curing process. This reduction not only decreases the overall thickness of the membrane switch in the final device but also reduces the cost and process time to produce.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
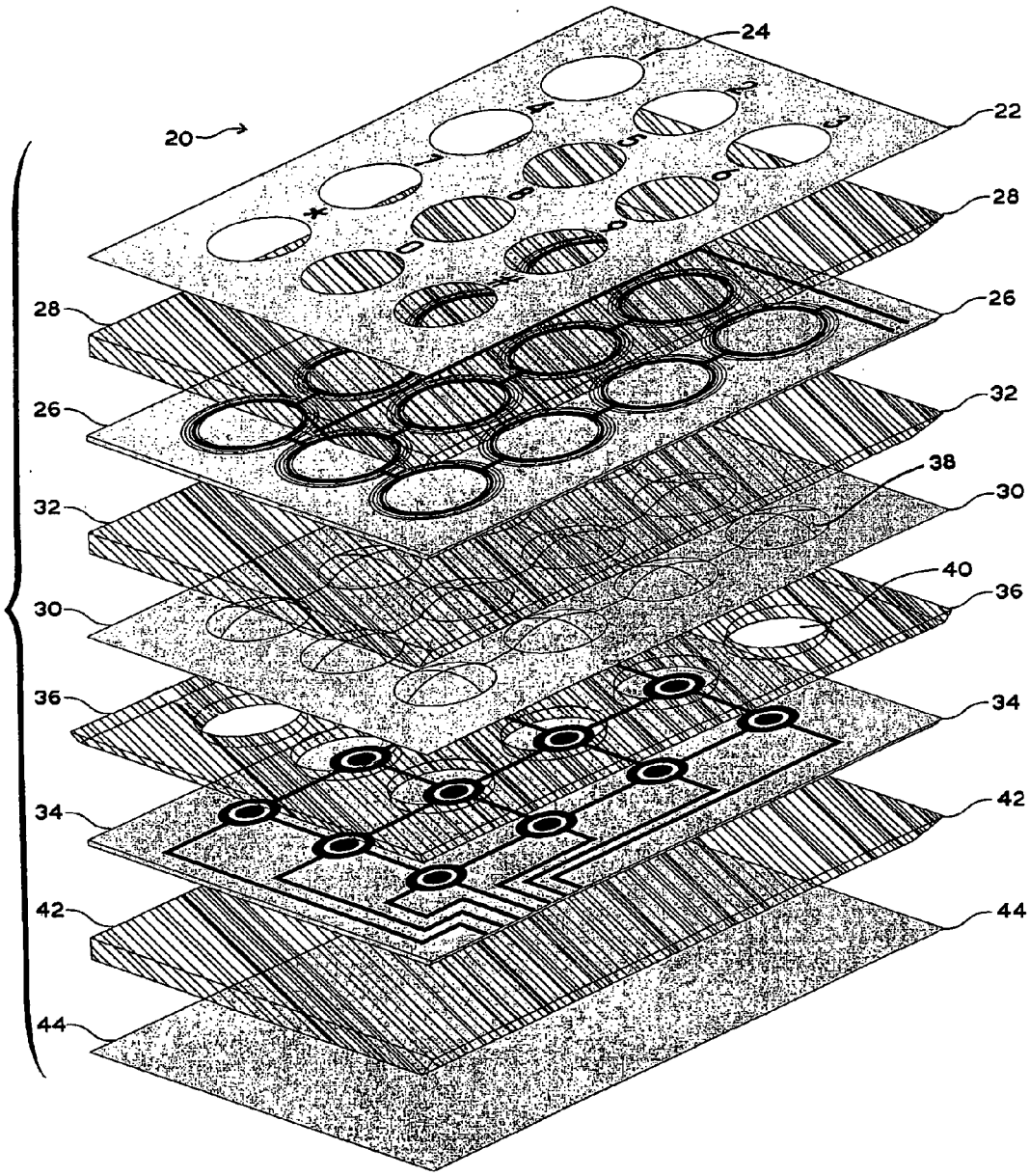
Fig 1 Prior Art
FIG. 1 is an exploded perspective view illustrating the construction of a conventional membrane switch that includes an electroluminescent lamp.
Figure 2:
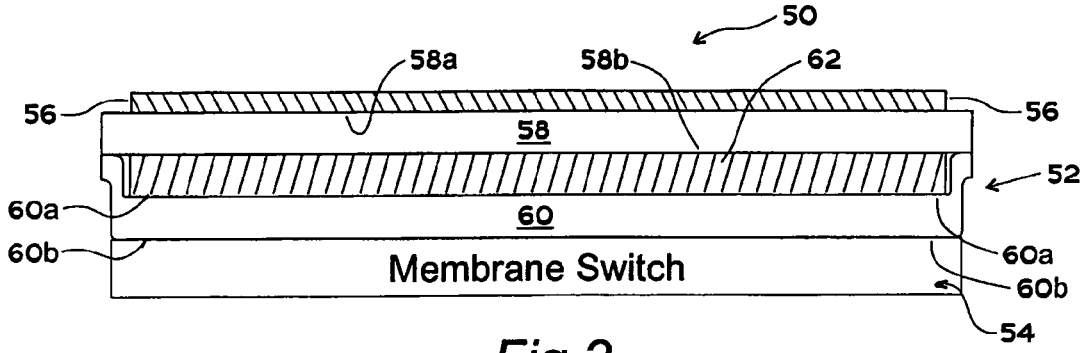
FIG. 2 is a cross-sectional view of the present electroluminescent lamp membrane switch.

Referring to FIG. 2, the present continuously printed electroluminescent lamp membrane switch combination is illustrated, and is generally identified by the numeral 50. Switch 50 includes an electroluminescent lamp membrane system, generally identified by the numeral 52, a membrane switch, generally identified by the numeral 54 and a graphics layer 56. Lamp system 52 includes a top insulating layer 58 and a bottom insulating layer 60. Top layer 58 has a front surface 58*a* and a back surface 58*b*. Bottom insulating layer 60 includes a front surface 60*a* and a back surface 60*b*. Disposed between insulating layers 58 and 60 is an electroluminescent lamp 62. Lamp 62 includes various layers which will subsequently be described with respect to FIG. 8. Lamp 62 may comprise, for example, the electroluminescent lamp shown and described in U.S. Pat. No. 5,856,030, which disclosure and drawings are hereby incorporated by reference.

Top insulating layer 58 of lamp system 52 is directly imprinted on graphics layer 56. Graphics layer 56 may include, for example, alpha numeric indicia which may be printed using a wide variety of inks, such as, for example, UV cured polyurethane inks. No die cutting or lamination is required to form the combined graphics layer 56 and insulating layer 58 of lamp system 52. Insulating layers 58 and 60 may comprise, for example, UV curable polyurethane ink.

Membrane switch 54 may comprise various types of membrane switches which include two electrodes which provide a tactile feedback component to provide a user with an indication as to whether the switch has been actuated or not. Various components of membrane switch 54 are illustrated in FIGS. 8–13. Membrane switch 54 may be attached to back surface 60*b* of insulating layer 60 utilizing a printable adhesive layer. Membrane switch 54 may be produced in a continuous process by printing elements directly on the electroluminescent lamp, or attached to the lamp system by laminating or by printable adhesives, depending on the type of switch desired and the amount of the tactile feel desired.

Figure 3:
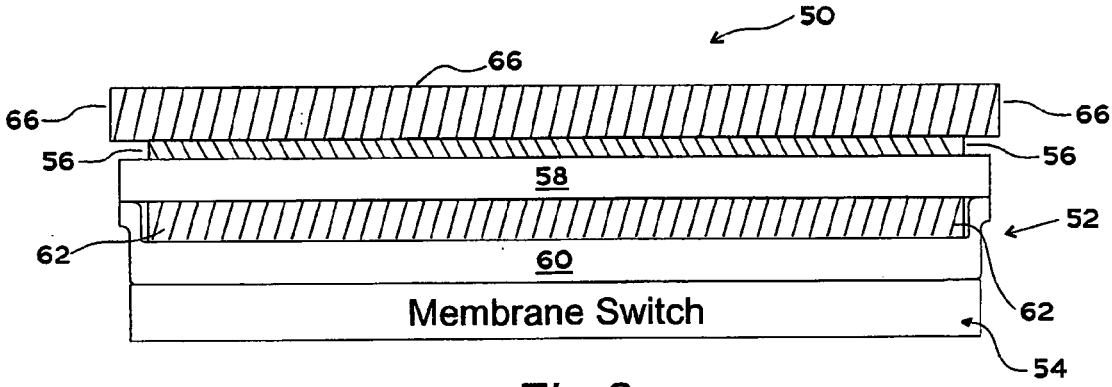
FIG. 3 is a cross-sectional view of an additional embodiment of the present invention.

Referring now to FIG. 3, switch 50 is illustrated as being integrally formed on a deformable substrate 66 which may comprise, for example, a layer of polycarbonate or polyester. Graphics layer 56 is directly printed on substrate 66 and is followed by insulating layer 58. Substrate 66 provides a surface for a user to actuate switch 54 by depressing a portion of the deformable substrate 66. Graphics layer 56 is protected by deformable substrate 66 since graphics layer 56 is disposed between deformable substrate 66 and insulating layer 58.

Figure 4:
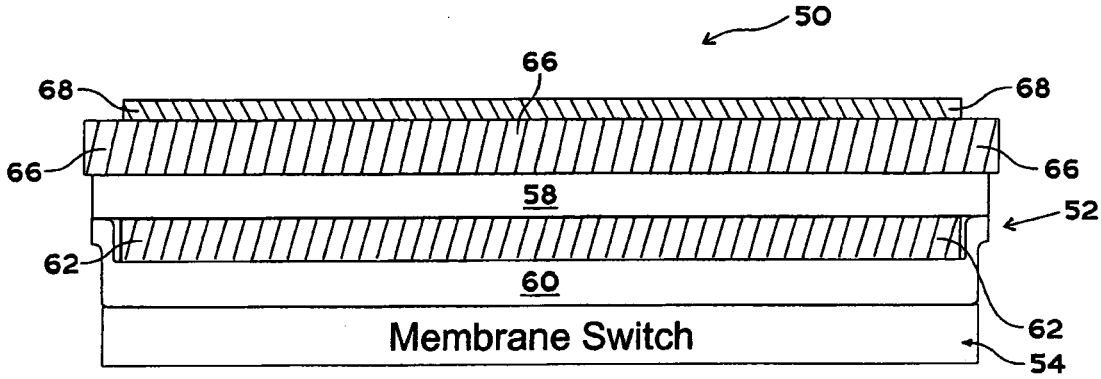
FIG. 4 is a cross-sectional view of an additional embodiment of the present invention.

Alternatively, as illustrated in FIG. 4 graphics layer 68 may be imprinted on the outer surface of deformable substrate 66.

Figure 5:
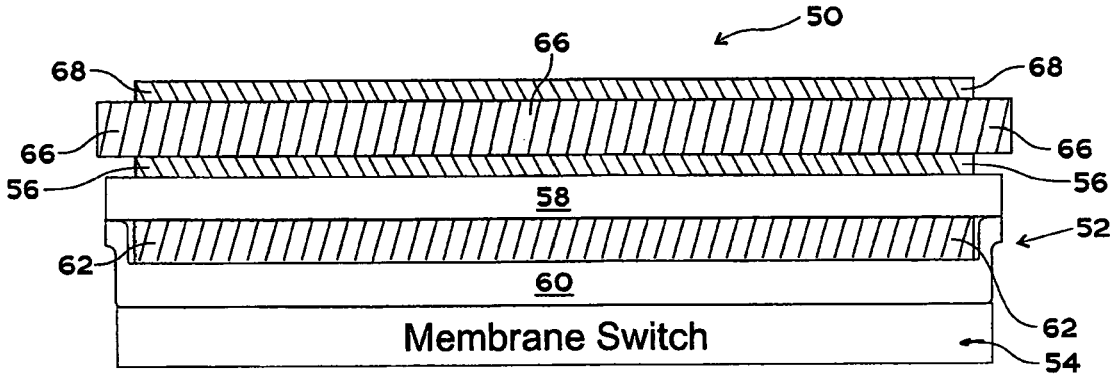
FIG. 5 is a cross-sectional view of an additional embodiment of the present invention.

Multiple layers of graphics may be included in switch 50, as illustrated in FIG. 5, wherein both graphic layers 56 and 68 are utilized and are imprinted on the inner and outer surfaces of deformable substrate 66. In this manner, multiple graphic indicia may be utilized with switch 50 and illuminated utilizing lamp system 52. As previously indicated, graphic layers 56 and 68 may include various indicia, and may further include various multicolored graphic designs.

Figure 6:
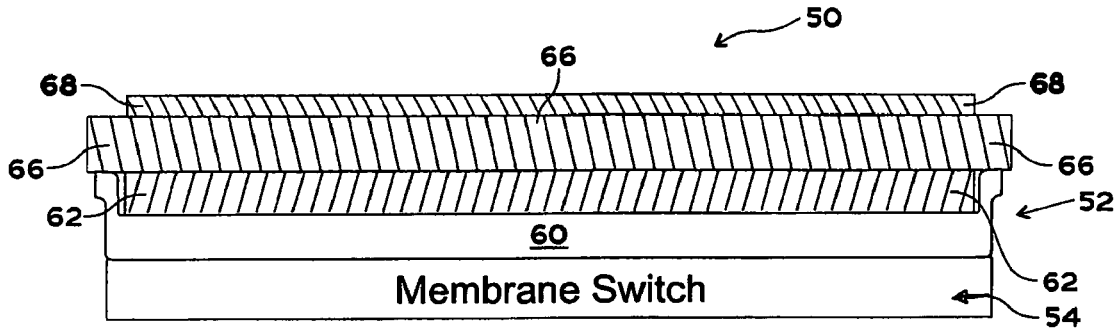
FIG. 6 is a cross-sectional view of an additional embodiment of the present invention.

FIG. 6 further illustrates an additional embodiment of switch 50 in which insulating layer 58 is eliminated and lamp 62 is directly imprinted on deformable substrate 66.

Figure 7:
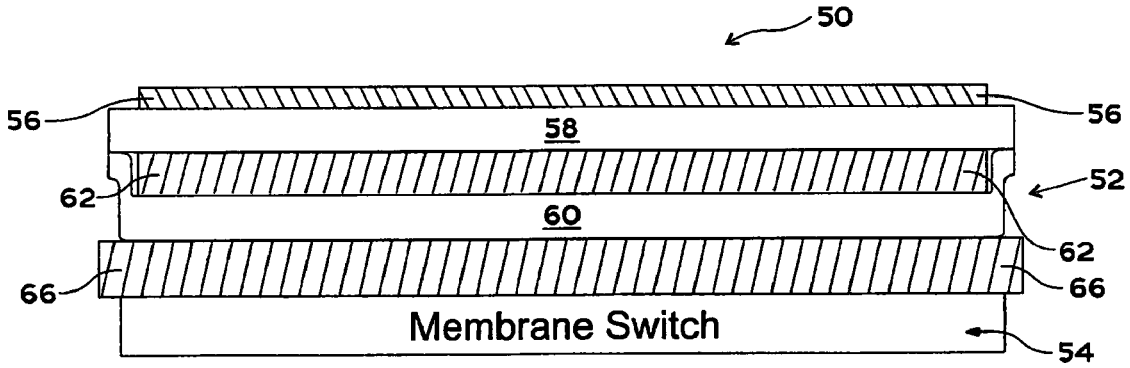
FIG. 7 is a cross-sectional view of an additional embodiment of the present invention.

FIG. 7 illustrates a further embodiment of switch 50 in which deformable substrate 66 is disposed between lamp system 52 and membrane switch 54.

Figure 8:
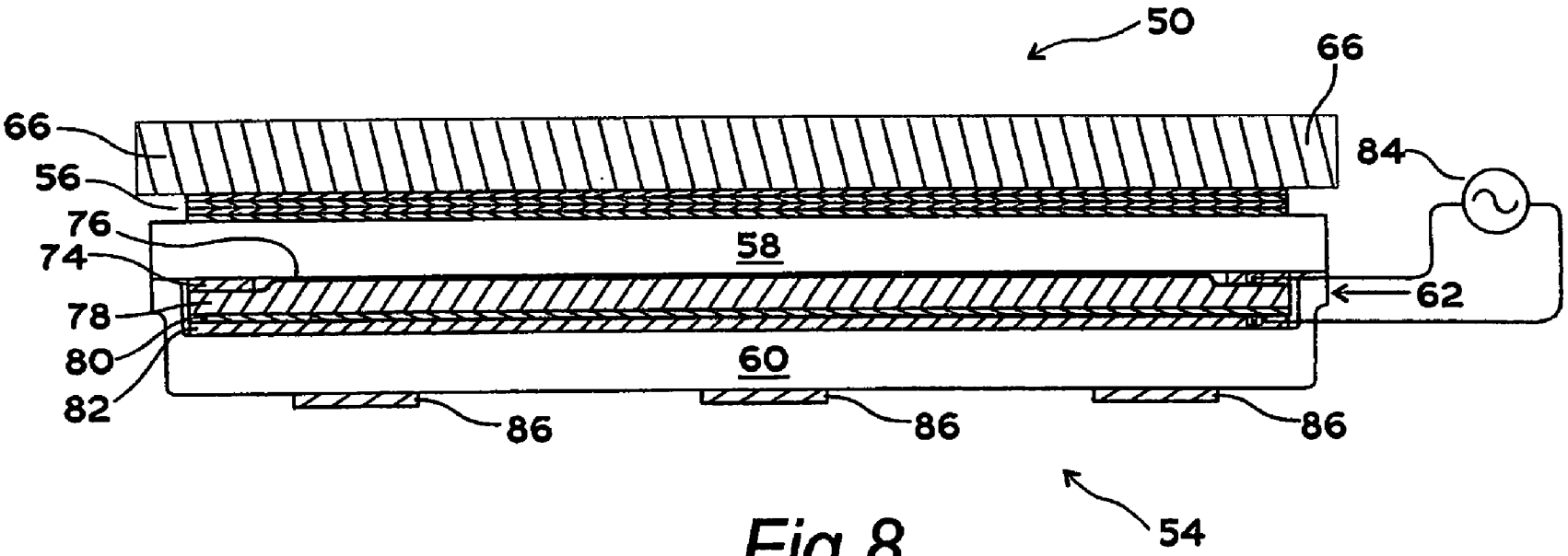
FIG. 8 is a cross-sectional view of the present invention illustrating the construction of an electroluminescent lamp and portions of a membrane switch.

Referring now to FIG. 8, an illustrative example of an electroluminescent lamp 62 is illustrated, it being understood that lamp 62 is shown for illustrative purposes only, and not by way of limitation. Lamp 62 includes a bus bar 74 that is printed on insulating layer 58. A transparent electrically conductive front electrode 76 is then printed onto insulating layer 58. A phosphor layer 78 is printed and is disposed on front electrode 76. A high dielectric constant layer 80 is then printed onto layer 78. Layer 80 may contain, among other compositions, for example, barium titanate. A rear electrode 82 is imprinted on layer 80. Electrode 82 may include electrically conductive ink, typically containing silver or graphite. The inks used to print the various layers of lamp 62 may include UV curable inks. Insulating layer 60 is printed onto electrode 82 to complete the lamp system 52. Power is supplied to electrodes 74 and 82 from a power supply 84.

FIG. 8 also illustrates a component of membrane switch 54 including conductive pads 86 which are imprinted on insulating layer 60.

Figure 9:
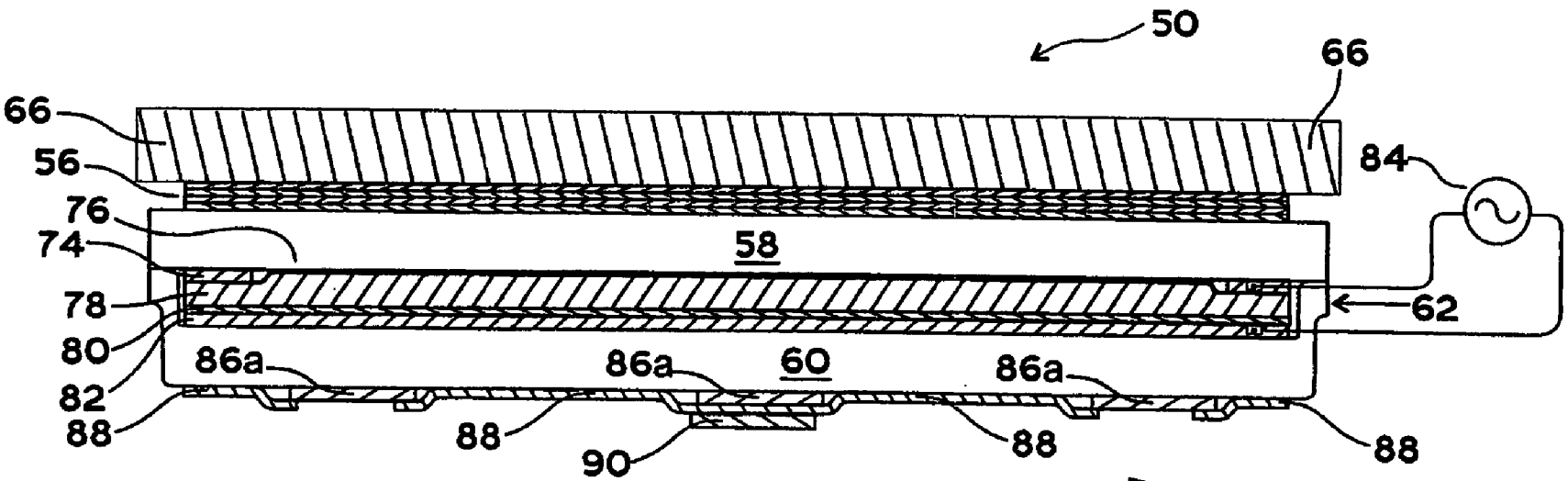
FIG. 9 is a cross-sectional view of the present invention illustrating the construction of an electroluminescent lamp and portions of a membrane switch.
Figure 10:
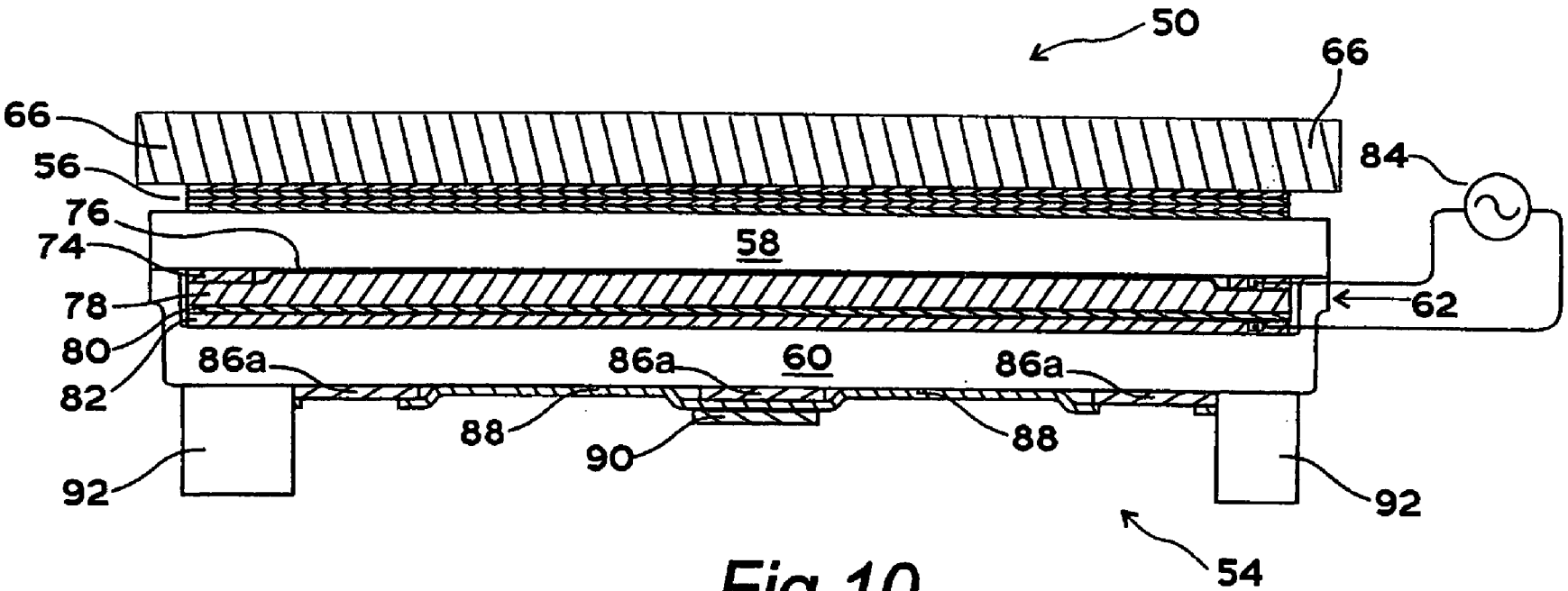
FIG. 10 is a cross-sectional view of the present invention illustrating the construction of an electroluminescent lamp and portions of a membrane switch.

FIGS. 9–13 further illustrate components within membrane switch 54. FIG. 9 illustrates an insulating layer 88 disposed on insulating layer 60 and between a conductive trace 86*a* which is part of an electrical switch circuit. An additional conductive pad 90 is illustrated and is the other half of the switch circuit and is disposed opposite trace 86*a*. FIG. 10 illustrates the further use of spacer elements 92 within switch 54.

Figure 11:
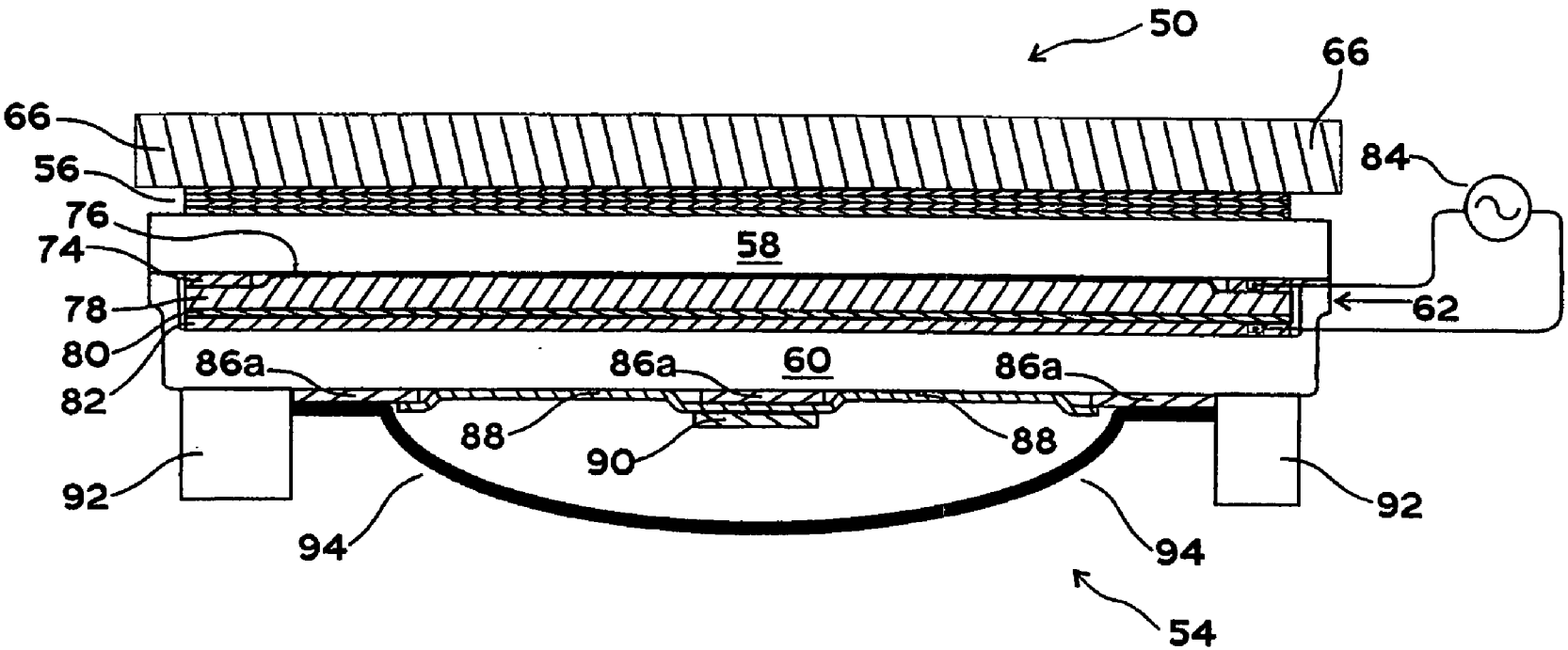
FIG. 11 is a cross-sectional view of the present invention illustrating the construction of an electroluminescent lamp and portions of a membrane switch.

As shown in FIG. 11, disposed between spacer elements 92 is a snap dome 94 which provides tactile feedback to the user of the present switch 50.

Figure 12:
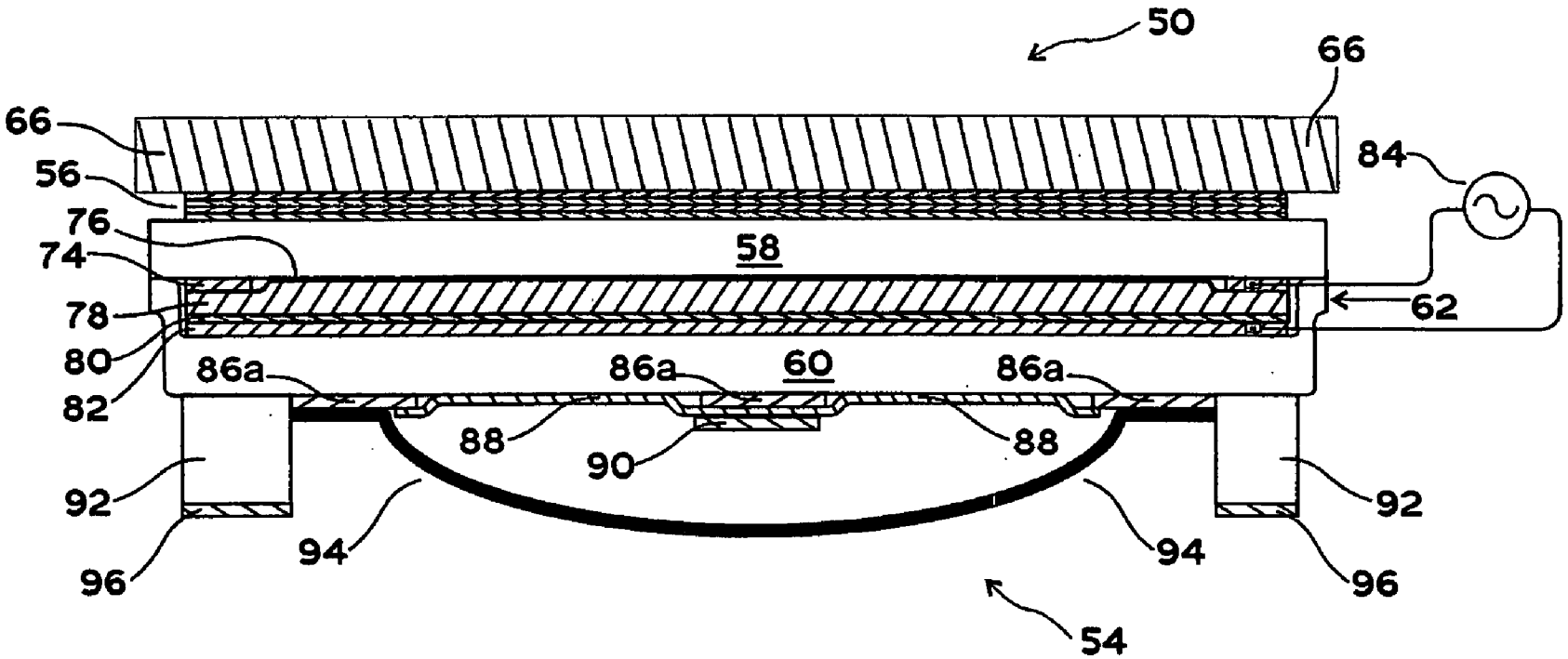
FIG. 12 is a cross-sectional view of the present invention illustrating the construction of an electroluminescent lamp and portions of a membrane switch.

FIG. 12 illustrates the addition of adhesive layers 96 to spacers 92. Adhesive layers 96 function to attach the remaining outer layer 100 (FIG. 13) of switch 54.

Figure 13:
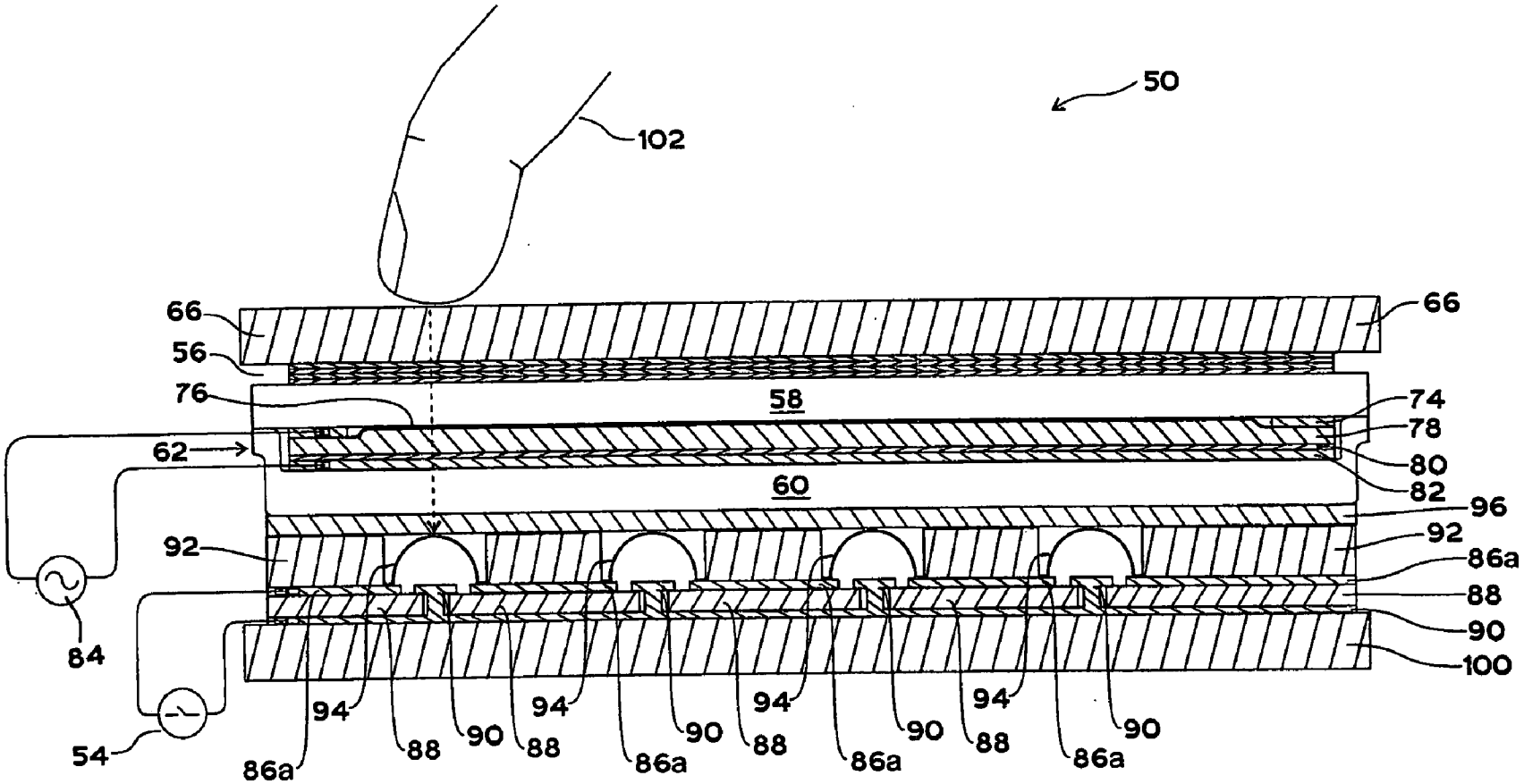
FIG. 13 is a cross-sectional view of the present invention illustrating the construction of an electroluminescent lamp and portions of a membrane switch.

FIG. 13 illustrates a completed switch 54. Closure of switch 54 is accomplished by a user 102 applying pressure from the deformable substrate 66 which results in compression of a snap dome 94 to complete the circuit between conductive pads 86 and 90.

Figure 14:
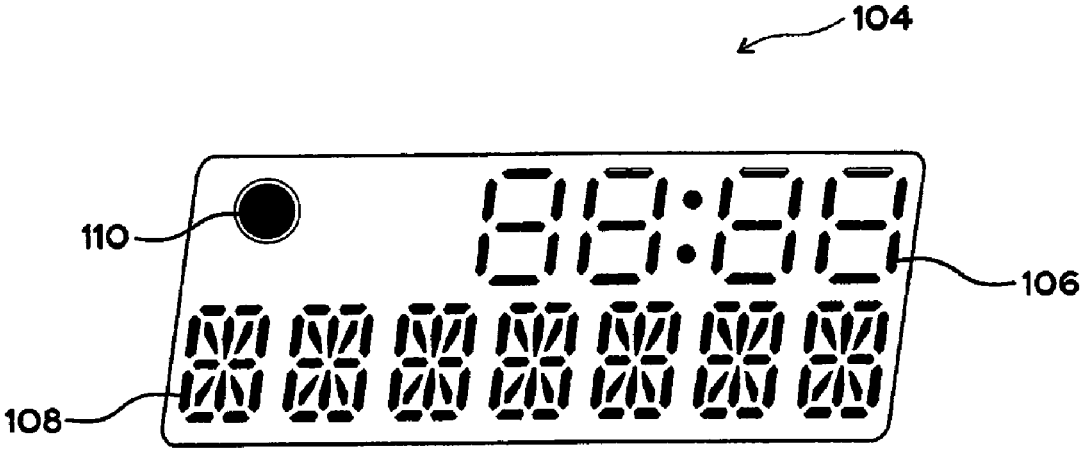
FIG. 14 is an illustration of a graphic display utilized with the present invention.

FIG. 14 illustrates an example of graphic indicia which may be included in graphics layers 56, 68 and 62. A display 104 includes a numeric display 106 and an alpha display 108. Display 104 also includes the necessary electronic circuitry for illuminating segments within display 106 and 108. Display 104 also includes an indicator light 110.

Other alteration and modification of the invention will likewise become apparent to those of ordinary skill in the art and upon reading the present disclosure, and it is intended that the scope of the invention disclosed herein be limited only by the broadest interpretation of the appended claims to which the inventor is legally entitled.

We claim:

1. An electroluminescent lamp membrane switch comprising:

an electroluminescent lamp having a front surface and a back surface, and a membrane switch formed on said back surface of said lamp.

2. The electroluminescent lamp membrane switch of claim 1 wherein said front surface of said lamp includes an insulating layer.

3. The electroluminescent lamp membrane switch of claim 1 wherein said back surface of said lamp includes an insulating layer.

4. The electroluminescent lamp membrane switch of claim 1 and further including:

graphic indicia formed on said front surface of said lamp.

5. The electroluminescent lamp membrane switch of claim 4 wherein said graphic indicia includes an alpha display.

6. The electroluminescent lamp membrane switch of claim 4 wherein said graphic indicia includes a numeric display.

7. The electroluminescent lamp membrane switch of claim 1 and further including:

a film formed on said first surface of said lamp.

8. An electroluminescent lamp membrane switch comprising:

a deformable substrate having a front surface and a back surface;

an electroluminescent lamp having a front surface and a back surface, said front surface being imprinted on said back surface of said deformable substrate; and a membrane switch formed on said back surface of said lamp.

9. The electroluminescent lamp membrane switch of claim 8 and further including:

graphic indicia imprinted on said deformable substitute.

10. The electroluminescent lamp membrane switch of claim 9 wherein said graphic indicia is imprinted on said front surface of said deformable substrate.

11. The electroluminescent lamp membrane switch of claim 9 wherein said graphic indicia is imprinted on said back surface of said deformable substrate.

12. The electroluminescent lamp membrane switch of claim 8 wherein said front surface of said lamp includes an insulating layer.

13. The electroluminescent lamp membrane switch of claim 12 wherein said back surface of said lamp includes an insulating layer.

14. The electroluminescent lamp membrane switch of claim 13 wherein said front surface and said back surface insulating layers of said lamp form an envelope for enclosing said lamp.

15. The electroluminescent lamp membrane switch of claim 9 wherein said graphic indicia is imprinted on said front surface and said back surface of said deformable substrate.

16. The electroluminescent lamp membrane switch of claim 9 which said graphic indicia includes an alpha/numeric display.

17. An electroluminescent lamp membrane switch comprising:

an electroluminescent lamp enclosed in an insulating envelope, said envelope having a top layer having a front surface and a back surface and a bottom layer having a front surface and a back surface; and a membrane switch formed on said back surface of said bottom layer of said envelope.

18. The electroluminescent lamp membrane switch of claim 17 and further including:

graphic indicia imprinted on said top layer of said envelope.

19. The electroluminescent lamp membrane switch of claim 17 and further including:

a flexible substrate having a front and a back surface; and said front surface of said top layer of said envelope being imprinted on said flexible substrate.

20. The electroluminescent lamp membrane switch of claim 19 and further including graphic indicia imprinted on said flexible substrate.

21. The electroluminescent lamp membrane switch of claim 20 wherein said graphic indicia is imprinted on said front surface of said flexible substrate.

22. The electroluminescent lamp membrane switch of claim 20 wherein said graphic indicia is imprinted on said back surface of said flexible substrate and said front surface of said top layer of said envelope is imprinted on said graphic indicia.

23. The electroluminescent lamp membrane switch of claim 20 wherein said graphic indicia is imprinted on said front surface and said back surface of said flexible substrate and said front surface of said top layer of said envelope is imprinted on said graphic indicia on said back surface of said flexible substrate.

24. The electroluminescent lamp membrane switch of claim 20 wherein said graphic indicia includes an alpha/numeric display.

* * * * *